United States Patent [19]

Darrow

[11] Patent Number: 5,030,886

[45] Date of Patent: Jul. 9, 1991

[54] SELF-CHECKING CIRCUIT ARRANGEMENT FOR OPERATION OF A SEARCHLIGHT SIGNAL

[75] Inventor: John O. G. Darrow, Murrysville, Pa.

[73] Assignee: Union Switch & Signal Inc., Pittsburgh, Pa.

[21] Appl. No.: 528,434

[22] Filed: May 25, 1990

[51] Int. Cl.[5] ..... H01J 1/60

[52] U.S. Cl. ..... 315/133; 340/907; 246/220

[58] Field of Search ..... 315/133, 132, 136; 340/907; 246/220, 162, 131, 473.3, 473 R

[56] References Cited

U.S. PATENT DOCUMENTS 1,610,692 12/1926 Logwood ..... 340/907
2,178,294 10/1939 Young ..... 315/133
2,961,206 11/1960 Coakley ..... 246/220
3,176,127 3/1965 Albrighton ..... 246/220
3,241,003 3/1966 Snell et al. ..... 246/220

*Primary Examiner*—Eugene R. LaRoche
*Assistant Examiner*—Tan Xuan Dinh
*Attorney, Agent, or Firm*—Buchanan Ingersoll

[57] ABSTRACT

The circuit arrangement of this invention includes a signal searchlight wherein the lamp is in an electrical series circuit with interlock contact switches. The switches interlock the display color lens such as yellow and green to control the electrical energization of the signal circuit. Logic control switching devices in a remote wayside control box supply signals through a cable to operate a bipolar device to selectively display the desired color.

22 Claims, 4 Drawing Sheets

SELF-CHECKING CIRCUIT ARRANGEMENT FOR OPERATION OF A SEARCHLIGHT SIGNAL

BACKGROUND OF THE INVENTION

The searchlight signal is generally a single lamp device located along the wayside of a railroad to provide information to the locomotive concerning current track operating conditions. The searchlight signals are generally a single lamp device in which the color of the signal light source is colored either red, green, or yellow by interposing colored lens in front of the single lamp. The devices are normally designed with the yellow and green lenses being held away from the light path by gravity and/or springs such that the device tends to fail in the red mode. The locomotive engineer interprets the red signal as a warning and normally would proceed to stop forward motion on such a track. The green signal is generally an all clear signal, and generally indicates no safety speed restrictions on that block of track. The yellow is a caution and its specific operating requirements may vary with different railways, but is usually indicated to proceed at some limited speed of operation of the train into the next section of track. It can be understood that a false energization or a sticking of the lens in the yellow or green positions could result in an error condition in which the vital mode of operation on the section of track would not be properly communicated to the on-board personnel. It is therefore highly desirable that in any failure mode the red signal be shown.

One way in which the lens systems have been operated is through the use of a bipolar or double acting electric solenoid. Typically when the electric solenoid is activated by a current of a given polarity it will move the yellow lens in front of the light source, and when the solenoid is activated by a current of the reverse polarity the green lens will be moved into the path of the light source. With the solenoid deenergized the green and yellow lenses are withdrawn from the path of the light source and the red lens is positioned to give a red signal. At any time in which the operation of the signal light is in doubt it is desirable to show the most restrictive color, namely red, or no light signal whatsoever. If the light signal is not given, the locomotive engineer can then assume that the signal is not functioning properly and take appropriate action, such as would be usually done under the red or most restrictive condition. Mechanically interlocking the red, green, and yellow lenses helps to assure the correct operation of a given signal. Such signal lights have always been a concern in the railway industry, and it has been a practice to better indicate the correct signal by having switches mounted on each color lens, especially the yellow and green lenses. These switches are activated when the respective lens is either fully engaged or fully removed from the light source path. Prior art solutions to insure reliability and vitality of operation have been to run the contacts from the respective yellow and green lens switches down from the light mast via a cableway to the wayside control where such contacts have been used in a relaying system to check and verify the position of the respect yellow and green lenses. Such verification could then indicate whether a malfunction had occurred and appropriate circuitry at the wayside could provide for a back-up operating condition. Under such back-up position the circuitry would generally prevent lamp energization unless the proper lens carrier was in the proper position. The wiring arrangement generally used in the prior circuits would be eight wires going back to the wayside control from the signal, namely one pair from the yellow contacts, one pair from the green contacts, one pair from the light filament, and one pair for the bipolar solenoid operation. Such additional wiring, cabling, and the associated inter-connections can introduce other potential failure problems such as conductor to conductor shorts within the cable bundles.

It is one of the objects of this invention to provide for vital operation of a multi-color searchlight while limiting the number of wires that must be run between the wayside signal control and the signal light device itself. In addition to achieving a vital searchlight operation, the circuits also reduce the number of conductors that must be run thereby improving the ease of installation and reducing the chances for large multiple conductors to cause the circuit to have shorts or cross connections.

It is also one of the objects of this invention to provide for a direct and simple circuit that can be checked for vitality and that is compatible with existing searchlight mechanisms.

SUMMARY OF INVENTION

This invention provides for a simple circuit which uses the electrical contacts that are mechanically interlocked with the yellow and green lenses in a single light source searchlight to provide vital logic to control the current to the light source. The circuit uses the connection of the green and yellow interlocking contacts in a series arrangement with the light source to provide a vital operating circuit which requires four or less electrical conductors between the actual signal and the wayside control.

PRESENTLY PREFERRED EMBODIMENTS

Further understanding of the invention can be gained with reference to the presently preferred embodiments shown in FIGS. 1 through 4. In these figures certain switching devices have been shown in a circular representation having R, Y, or G referenced letters within the circle. These switching devices can be manually operated switches, relay contacts, solid state devices or other switching devices which provide a closure when the respective color condition is desired. The letter within the circular switching device indicates R for red, Y for yellow, G for green, or specified combinations of these desired color conditions where more than one reference letter is shown. The switching devices may be any device or control including computer logic which acts as a contact closure function.

Figure 1:
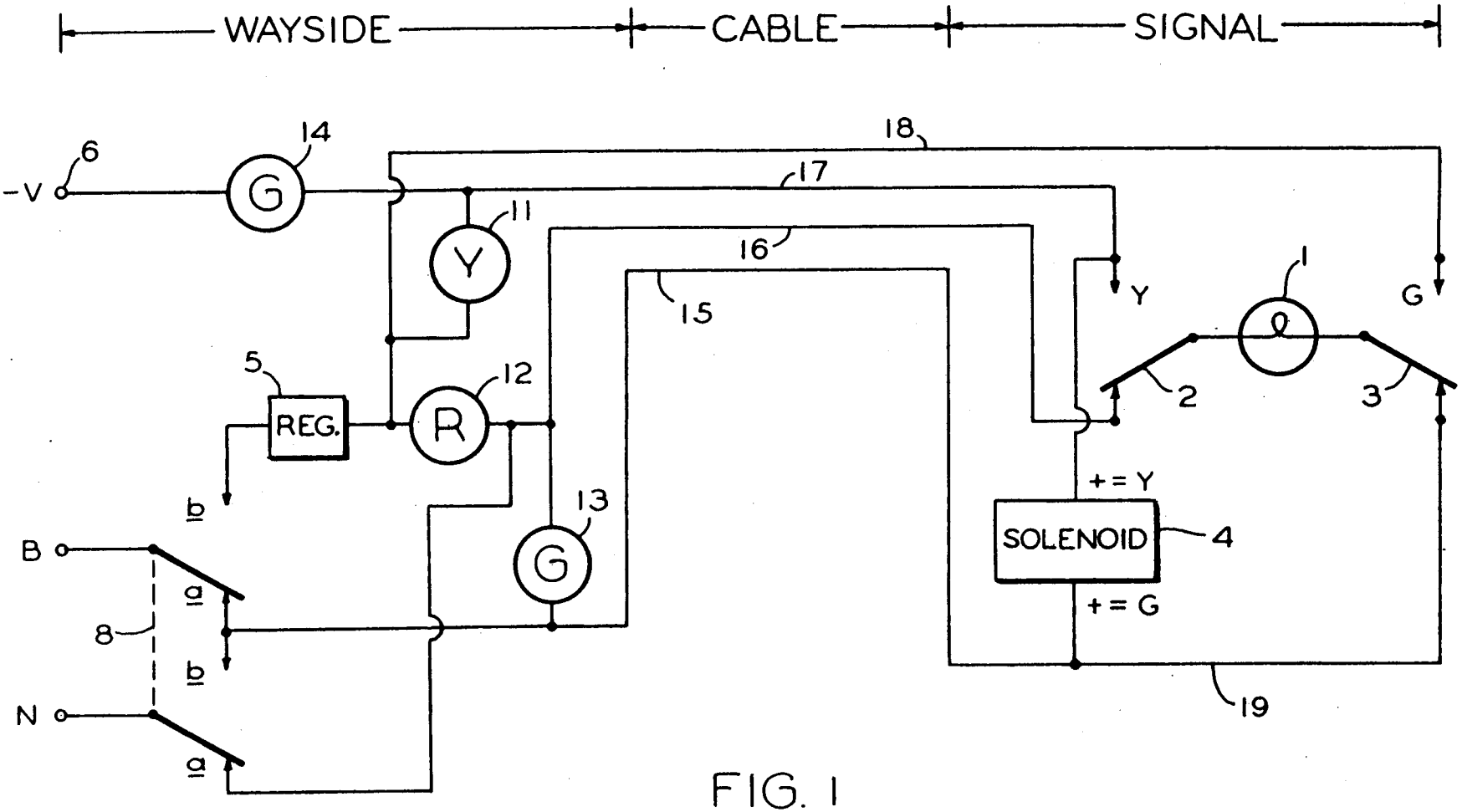
FIG. 1 is an electrical schematic of a presently preferred embodiment showing the portion of the circuit located in the signal and the portion of the circuit located in the wayside control and the four conductor inter-connecting cable between the signal and wayside control box.

Referring now specifically to FIG. 1 there is shown a searchlight signal lamp 1 which for purposes of this drawing is shown as being a filament type lamp. Associated with the lamp but not shown are green, yellow, and red lenses which are mechanically arranged so as to selectively position the respective color in front of the light source so that the searchlight signal will appear to be either yellow, green, or red. The lens carriers are moved to a yellow or green position by operation of the bipolar lens operating solenoid 4. When a voltage of a positive polarity is placed on the solenoid, in the direction shown by +=Y, the directional current within the solenoid will move the yellow lens into a display position. Conversely when a voltage with a positive polarity is placed on the side of the solenoid 4 indicated by +=G, the oppositely directed current within the solenoid will move the lens carrier to a display the green color position. Interlocked to the lens carriers, in this embodiment mechanical interlocking is contemplated, are two interlocking switches 2 and 3. As shown in FIG. 1 when neither yellow nor green lenses are positioned the transfer contacts associated with switches 2 and 3 are in the down position indicating that neither yellow nor green lenses are in the light display path of the filament of lamp 1. It is assumed that when both yellow and green lenses are in the down position, the red lens is mechanically interlocked to be in the direct light path of the searchlight 1. If solenoid 4 is activated by a voltage having a positive polarity on the side indicated +=Y then the solenoid would operate to move the respective yellow carrier in front of the lamp 1 and simultaneously move transfer contact from switch 2 to the up or (Y) yellow position. Conversely if an opposite polarity voltage is applied to solenoid 4 such that the +=G side of the solenoid is now made positive, the solenoid 4 would operate to move the green lens carrier in front of the lamp 1 and simultaneously interlock switch 3 would move the respective transfer contact up to the (G) green position. This mechanical interlocking of switches 2 and 3 to the colored lenses is known from the prior art. As can be seen, the necessary current path through the solenoid 4 is controlled by operation of the wayside located control elements.

A fail-over relay 8 has one of its input terminals B connected to a source of positive voltage such as the plus terminal of a battery, and the other of the fail-safe relays terminals N connected to a negative or common voltage ground source. The fail-over relay 8 is used at the wayside position and indicates either an operating mode or a non-operating mode. This device can also be achieved using solid state or computer logic, but is shown in the presently preferred embodiment as a fail-over electromechanical vital relay device. In the system a vital fail-over relay is used which is picked-up if the system operation is in the proper mode, but which drops out if the safety factors built into the electronic or logic control system indicate that the system no longer has proper control of the searchlight signal. In such case when the fail-over relay drops out the red indication light if possible must be shown, but no failure of the lens control shall result in a yellow or green indication. When the relay 8 is picked-up into position b, the plus voltage is then fed to a voltage regulator 5 which may have functions of voltage stabilization, voltage boost or regulation, and surge protection. If a red light indication is desired only the red switching device 12 is closed and devices 14, 13, and 11 remain open circuited. In such a case current flows through regulator 5 and through switching device 12 to conductor 16 in the cable. Inside the signal device conductor 16 is attached to the interlock switch 2 through the transfer contact associated with the yellow lens being in the non-displayed condition (as shown). Current can then flow through the transfer bar of switch 2 through the filament of lamp 1 to the interlock switch 3 via the transfer bar associated with the non-display of the green lens (down as shown) to wire 19. While wire 19 feeds one end of solenoid 4 it can be seen that the solenoid does not operate to move either of the lenses because a complete current path cannot be established, since switching elements 11 and 14 remain open circuited. A completed current path for the searchlight filament continues from wire 19 through conductor 15 in the cable to the negative terminal on relay 8 via the lower movable contact which is in the b position. In this manner a current path is established to light the filament of lamp 1 when the desired red lens is in the display position. If either the yellow or green lens are stuck in a display position such as due to mechanical failure the current is interrupted by respective interlock switches 2 or 3 to result in no color light being displayed.

When the yellow signal display is desired, switch device 11 is closed while switch devices 12, 13, and 14 remain open. Again the fail-over relay 8 is in the B position so the positive voltage at the B terminal of relay 8 passes through the regulator 5 to feed both switch device 11 and conductor 18. Switch device 11 provides positive voltage to conductor 17 which feeds into the signal box and the +=Y terminal on the solenoid 4. A return current path from the opposite end of solenoid 4 is provided by means of electrical conductor 15 which feeds through the b positioned lower contact on relay 8 to the N or negative terminal of the battery. This current path via conductors 17 and 15 provide operating current such that the bipolar solenoid 4 causes the yellow lens carrier to be moved in front of the light source thereby causing the interlocking switch 2 to be moved upward to the yellow display, (Y) position. At that time the current being supplied via conductor 17 is also provided with a path through switch 2 in its upward or yellow displayed (Y) position through the filament of lamp 1 and then via switch 3, in its down or non-green position, to wire 19. The completed lamp filament circuit similarly follows back through the cable via conductor 15. Similarly, if erroneously the yellow lens is down or the green lens is up in a display position, respective interlock switch 2 or 3 interrupts the current path to the filament of lamp 1.

When it is desired that the green lens be displayed in front of the filament lamp switch devices 14 and 13 are caused to close and switch devices 11 and 12 remain open circuited. Relay 8 is in its b position indicating that the wayside logic and control systems desire the signal light to function.

When it is desired to operate the green display mode the current path to solenoid 4 is from the negative voltage terminal 6 through switch device 14 which is now closed to conductor 17 to the signal housing which contain bipolar solenoid 4. The current returns via conductor 15 to the wayside control box where relay 8 is in position b and return path is provided to the neutral or ground via the lower movable contact. Such a current path provides a polarity through bipolar solenoid 4 such that a solenoid side marked +=G is positive, and the solenoid motor causes the lens carriers to move the green lens into a (G) display position in front of lamp 1. When the green lens is in front of the lamp, switch 3 which is mechanically connected to the lens is moved to its upper or (G) position and a filament current to lamp 1 is provided via fail-over relay input terminal B to regulator 5, to conductor 18 in the cable, via interlocking switch 3 which is in its (G) position or up position, to the filament in lamp 1, then through switch 2 which is in a non-display of yellow position (down), and then via conductor 16 to the wayside control box. Switch device 13 is now closed providing a path from cable conductor 16 to the relay 8 which is now connected via the lower movable contact in the b position to the neutral (N) terminal on the relays. Should the green lens move from the display green position the filament current is interrupted by switch 3. Should the yellow lens be erroneously moved into position the switch 2 terminates the current to filament in lamp 1.

As can be seen in the circuit of FIG. 1 the interlocking contacts 2 and 3 associated with respective yellow and green lenses are wired into the logic circuitry such as to provide that the red display can light only if both of the contacts are down or in their non-display yellow, non-display green positions. Also the signal can only light yellow if the yellow contact is up and similarly the green only if the green contact is up. In each case the fail-over relay contact when energized pass battery through a regulating device, through which ever control switch devices are closed, and if the lens carrier is in the correct position, through the check contacts of switches 2 and 3 to the lamp filament. Note that when the fail-over relay 8 drops it provides lamp voltage which is of the opposite polarity to that normally used through the red check contacts to the lamp. In each case, this applies positive voltage to the green position of the lens control solenoid, so that no possible short within the cable can make the lens carrier operated by solenoid 4 to shift to yellow; since there is no higher positive voltage in the system that could erroneously reach the Y terminal of solenoid 4.

If FIG. 1 four control wires are used in the cable and four switch devices are also used. In all cables it is anticipated that an additional ground wire for shielding purposes may be used. If the fail-over relay 8 drops it applies battery directly to the red interlock contacts and to the lamp, but of reverse polarity so that plus voltage is applied to the green control end of the solenoid. Thus no cable short can make the yellow end more positive, so the mechanism cannot shift to a yellow display position. If the cable wires 17 and 18 are shorted, the solenoid can shift to green but in so doing opens the path through the green interlock contact switch 3 to the lamp filament. Thus the solenoid 4 can be tied into the lamp voltages without any possibility of lighting other than the red in the event of the fail-over relay dropping.

Figure 2:
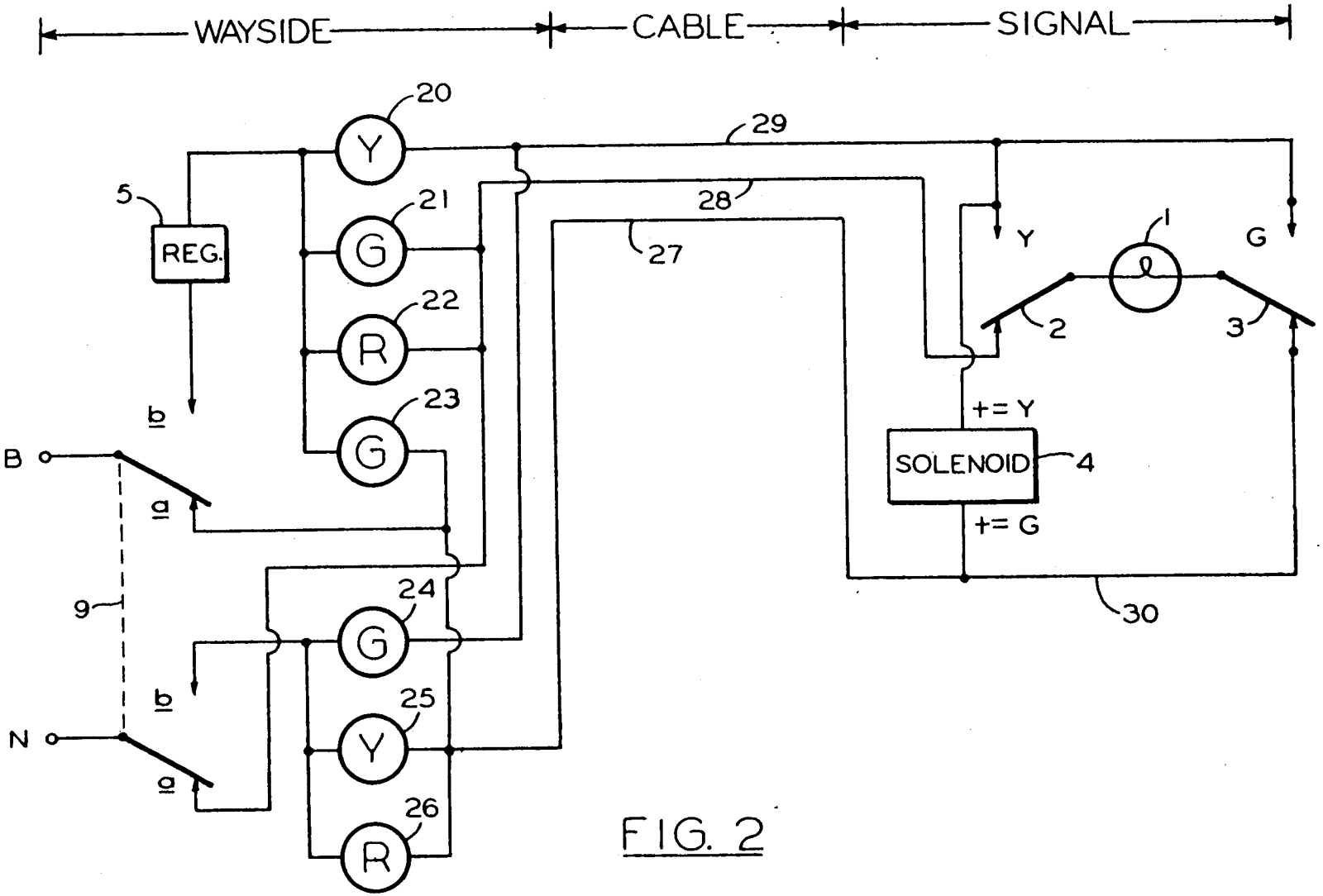
FIG. 2 is an electrical schematic of a presently preferred embodiment of a circuit using a three conductor cable to connect the circuit portions in the signal to those located in the wayside control box.

Referring now to FIG. 2 shows a second presently preferred embodiment which assumes a supply system where there is no power supply available other than the main battery. A pole changing operation for the solenoid is generally provided by control switch devices 20, 23, 24, and 25, while switch devices 21, 22 and 26 generally provide logic for the lamp 1. A total of seven switch devices are used, and only three conductors 27, 28, and 29 are required to be in the cable between the signal and the wayside control unit. In normal operation each color command can only operate the lamp if the lens carrier of the respective color is in the correct position. And, as in FIG. 1, a dropped fail-over relay 9 makes a cable short unable to operate the solenoid in the yellow direction and unable to light the lamp in the false green.

In normal operation if a red signal light is required the fail-over relay 9 is picked-up and positive battery voltage is fed from the B terminal of the relay 9 to the regulator 5 through the closed red (R) switch device 22 via conductor 28 in the cable to the signal unit. Within the signal unit positive voltage is supplied to the interlock yellow switch 2 which is in the non-yellow display position (down) through the filament in lamp 1 through switch 3 which is in the non-green display position (down) to wire 30. Wire 30 connects to a return path via cable conductor 27 to the wayside unit and via switching device 26 which is now closed to the b position of the lower switch contact on the relay 9 to the neutral terminal. Similar to the previous circuit the solenoid 4 cannot operate as a completed current path does not exist due to switch devices 20, 23, 24, 25 being in an open position.

When a yellow display is required and fail-over relay 9 has been picked-up plus voltage from the B terminal of the relay 9 is fed through the voltage regulator 5 through switch device 20 through the cable via conductor 29 to the +=Y side of the solenoid 4 and a return path from the solenoid 4 is available through the cable by conductor 27 to the wayside unit. From the wayside unit conductor 27 is provided with a return current path by (Y) switch device 25 which is now closed and connected through the b position contact on the lower switch to the N terminal of the fail-over relay 9. This current path causes the bipolar solenoid 4 to move the respective yellow lens carrier to a yellow display (Y) position causing switch 2 to move upward to (Y), the yellow display position. A positive voltage being available at the upper yellow transfer contact (Y) of switch 2, a current path through lamp filament via switch 2, lamp filament of lamp 1, and switch 3 which is in its down or non-green displayed position to wire 30. Filament current returns via conductor 27 in a cable similar to that current path used by solenoid 4.

When it is desired to display a green signal using the circuit arrangement shown in FIG. 2 and fail-over relay 9 is in the up position, positive voltage is supplied through regulator 5 through switch device 23 to conductor 27 in the cable. Conductor 27 feeds the signal unit supplying positive voltage to the +=G terminal of the bipolar solenoid 4. A return path is provided from the solenoid 4 via conductor 29 in the cable to the wayside control unit. Switch device 24 which is now closed provides a path to the neutral or negative side of the battery via lower switch of the fail-over relay 9 which is in the up, b position, which causes the lens carriers to move the green lens into a display position, and transfer switch 3 to the upper or G position. The filament current is provided via switch device 21, conductor 28 in the cable, interlocking switch 2 which is in the down or non-yellow display position, switch 3 which is upward or in the green display (G) position, and the cable conductor 29 providing the return path similarly as that used by the solenoid current through switch device 24 to the neutral or negative terminal of the fail-over relay 9 which is in the up or b position.

As can be seen from the circuit of FIG. 2 the circuit arrangement controls the signal device such that red can light only if both of the interlocking contacts are down, i.e., in their non-display yellow and green positions, and can only light yellow if the yellow interlock contact is up and can only light green if the green interlock contact is up. When the fail-over relay 9 of FIG. 2 drops it provides lamp voltage which is of the reverse polarity to that normally used through the red check contacts, switches 2 and 3 in the down position, to the lamp. In each case this supplies positive voltage to the green position of the lens control solenoid 4 so that no possible short within the cable can make the lens carrier shift to yellow. A dropped fail-over relay 9 makes a cable short unable to operate the solenoid 4 in the yellow direction, and unable to light the lamp filament 2 in a false green.

Figure 3:
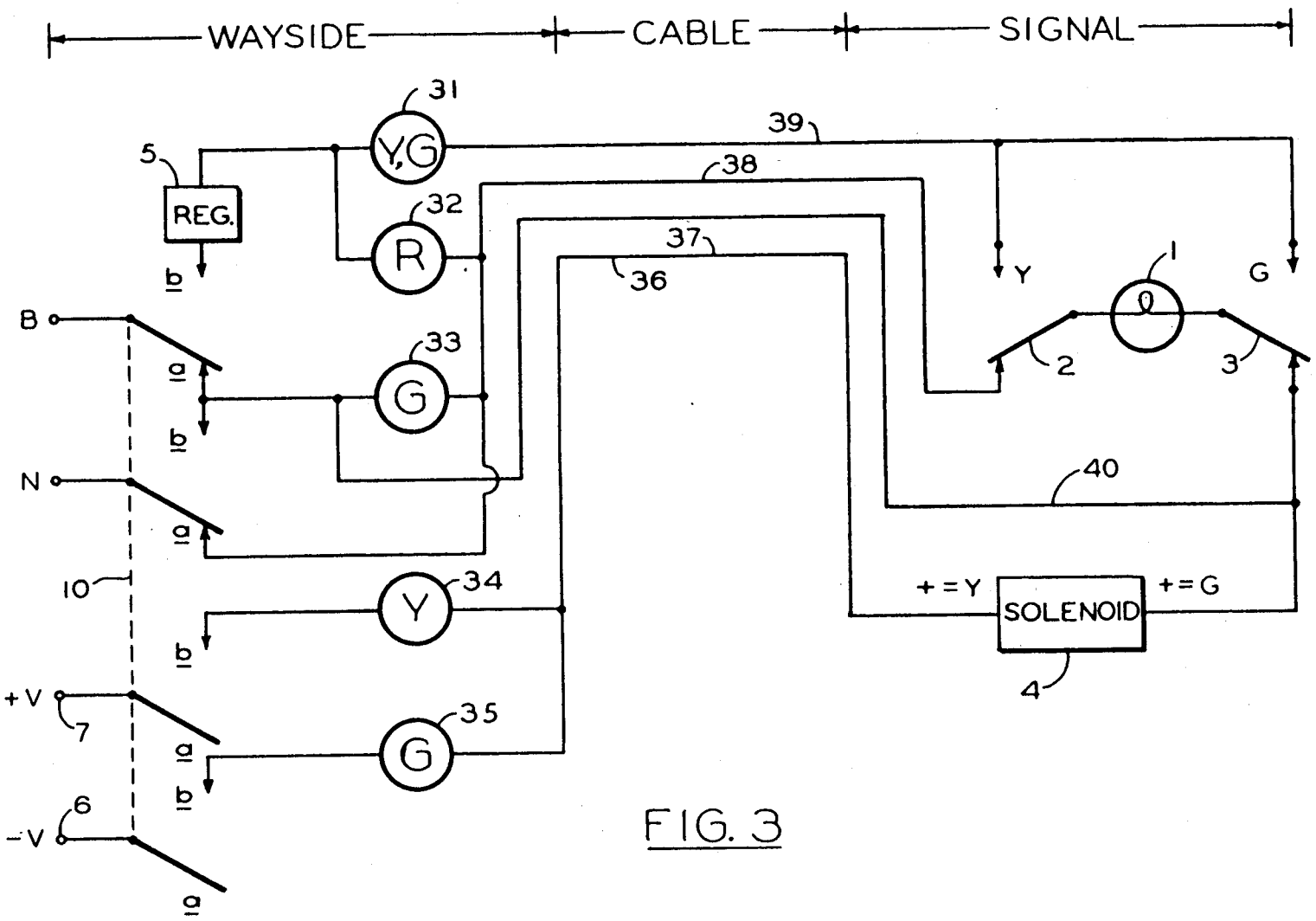
FIG. 3 is an electrical schematic of a presently preferred embodiment using a four conductor cable connecting portions of the circuit located in the signal with portions of the circuit located in the wayside control box.

Referring now to FIG. 3 there is shown a third embodiment which provides additional features over the embodiments of FIGS. 1 and 2. Because lamp solenoid supplies are separate, regulator 5 may be used in order to provide ramp-up voltage or a reduced voltage for cold filament checking. This could not be done in the circuit of FIGS. 1 and 2, which use the same voltage supply for both lamp and solenoid operation because the reduced voltage of the lamp supply in the cold test position would not be sufficient to operate the solenoid 4. Two separate power supplies are used in addition to the battery. These may be available for other function in the wayside equipment. This embodiment uses five switch devices 31 through 35 and requires the use of four conductors 36, 37, 38, and 39 in the cable that connects the signal light unit to the wayside control unit. Terminal 6 has a negative voltage supply connected to the terminal while terminal 7 has a positive voltage power supply connected thereto. The two remaining terminals of the fail-over relay 10 are respectively connected to the B or battery terminal and the N or neutral terminal. Switch device 31 is a device that creates a closed circuit between its respective terminals when either a yellow or a green display is desired.

If a red display is desired from the circuit in FIG. 3 and the fail-over relay 10 is picked-up, voltage is provided from the B terminal of the fail-over relay 10 to the regulator 5, then to switch device 32 which is in a closed state. Switch device 32 feeds conductor 38 in the cable which provides voltage to the remotely located signal. The filament of lamp 1 is fed via interlocking switch contacts on switches 2 and 3 which are both in the down position because neither green nor yellow are displayed. The return path for the current from the lamp filament from interlocking switch 3 is via wire 40 to conductor 37 in the cable which feeds the wayside unit and the neutral terminal on fail-over relay 10 via the second switch which is in the b or up position. Bipolar solenoid 4 operates neither lens carrier, as a completed current path does not exist. If yellow display is wanted the lens carrier is moved to the yellow position by positive voltage from the fail-over relay 10 which is in the up position b being fed from terminal 7 through the respective b contact to the switch device 34 which is closed because a yellow lens display is desired. Device 34 feeds a positive signal voltage to conductor 36 in the cable which feeds directly to the + =Y terminal of the solenoid 4 causing the solenoid to move the yellow lens into position in front of the lamp 1 and causing switch 2 to go to its upper position (Y) or a display yellow position. A return path for the current from solenoid 4 is provided through wire 40 to cable conductor 37 and from 37 to the neutral terminal on fail-over relay 10.

When a yellow display is required, positive voltage is fed from the relay terminal 7 through the contact in the up position, through switch devices 34 and wire 36 to the (Y) terminal of the solenoid 4, returning via wires 40 and 37, through the relay contacts to N, thereby moving the lens carrier to the yellow position. Battery voltage is fed via the battery terminal on the fail-over relay 10 which is in the up b position to regulator 5, to switch device 31. Switch device 31, which is closed because a yellow or green display is desired, provides voltage to conductor 39 in the cable. Cable 39 feeds the signal unit and supplies voltage to the interlocking switch 2 which is in the Y position having been moved there by solenoid 4. Current through the filament of lamp 1 returns via interlock switch 3 which is in the down position since green is not displayed, wire 40 and returned via conductor 37 in the cable to the neutral or negative terminal on the fail-over relay 10 which is in the up or b position.

When a green signal is desired the circuit shown in FIG. 3 causes the green lens carrier to be moved into position in front of lamp 1 by supplying a negative voltage via terminal 6 on fail-over relay 10 through switch device 35 to conductor 36 in the cable. Conductor 36 feeds the remotely positioned signal control having bipolar solenoid 4. Polarity in this direction causes solenoid 4 to move the green lens carrier into a display position (G) causing switch 3 to move to its upper or green (G) display position. The return path for current from the solenoid 4 is via wire 40 to cable 37, and then to the neutral on the fail-over relay 10. Filament current is provided from the B terminal on the fail-over relay 10 via voltage regulator 5 through switch device 31, which is now closed since a green (G) display is desired, through cable conductor 39 to switch 3 which is in the up or (G) position indicating a green display. Current from the switch 3 feeds filament of lamp 1 and returns via switch 2 which is in the down position, non-display yellow, and cable 38, through switch device 33, and to the N or neutral on the fail-over relay 10.

As with the previous circuits the arrangement provides that when the fail-over relay drops, lamp voltage which is of the opposite polarity to that normally used through the lamp 1 when the display is red, is directed to the not displayed green contact of 3, the lamp filament 1, and the not displayed yellow contact of 2. In each case this applies a positive voltage to the display green side of the lens control solenoid so that no possible short within the cable can make the lens carrier shift to yellow. The filament is only energized by the yellow switch devices when the interlocking switch 2 is in the up or yellow position and the green interlocking switch 3 is in the down or not display green position. Conversely, the circuit is only activated by the green switch devices when the green interlocking switch 3 is in the up position and the yellow interlocking switch 2 is in the down or not display yellow position. As in the other circuit versions when the fail-over relay 10 drops it provides lamp voltage which is of the opposite polarity to that normally used through the interlock contacts to the lamp. In each case this applies positive voltage to the green display side of the lens control solenoid 4 so that no possible short within the cable can make the carriers shift to yellow.

Figure 4:
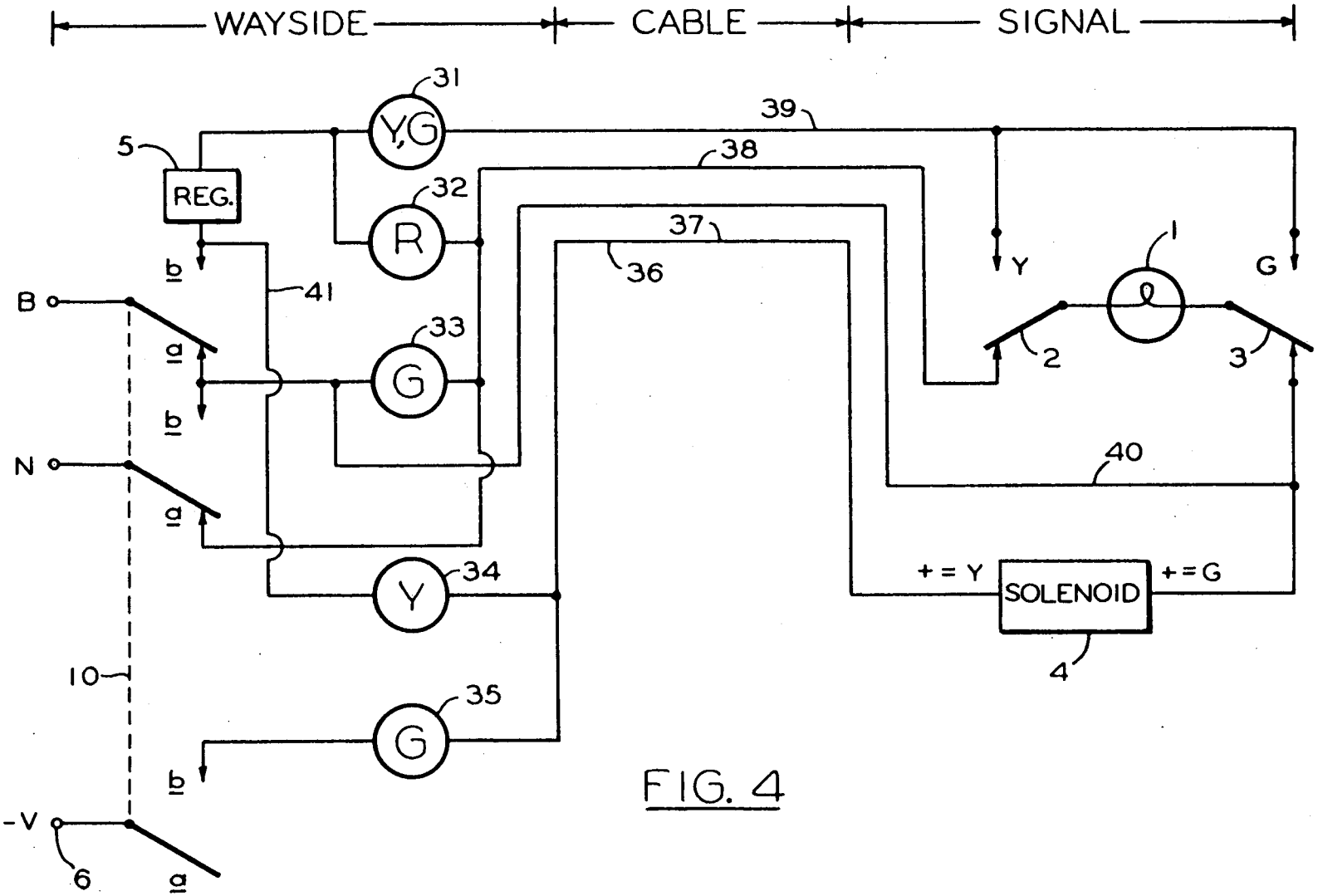
FIG. 4 is an electrical schematic of a presently preferred embodiment similar to that of FIG. 3 with identical reference numbers indicating similar devices, and not requiring a separate positive voltage source in addition to the battery voltage shown.

A further embodiment is shown in FIG. 4 which is a partial schematic of a circuit similar to that shown in FIG. 3. The cable and the signal circuits are identical to that of FIG. 3 and save a relay contact on the fail-over relay 10 and use only a single additional voltage source. Power is supplied before the voltage regulator 5 to the wire 41 which leads to the line side of switch device 34. This provides in essence a source of positive voltage when the fail-over relay 10 is picked-up or in the b position. The operation of the switching devices 31 through 35 are identical as that explained in relation to FIG. 3.

Although I have shown and described several forms of circuit apparatus which embody my present invention for a self-checking searchlight signal arrangement, it is understood that various changes and modifications may be made within the scope of the appended claims without departing from the spirit and scope of my invention. While functional switching devices have been discussed in this specification, other functional equivalents such as programs, microprocessors, solid state devices, and vital relays may be used within the scope of these claims.

I claim:

1. Searchlight signal circuit arrangement comprising:

(a) signal means having a visible output in response to an electrical signal;

(b) a first color interlock means located at said signal means for switching in response to the displayed color position of said signal means between a first current path when a first color is in the display position and a third current path when said first color is not in the display position;

(c) a second color interlock means located at said signal means for switching in response to the displayed color position of said signal means between a second current path when a second color is in the display position and a fourth current path when said second color is not in the display position;

(d) bipolar means located at said signal means for selectively displaying one of said first and second colors in response to an electrical signal indicative of color; and (e) said first color interlock means and said second color interlock means arranged in a series electric circuit with said signal means.

2. The searchlight signal circuit arrangement of claim 1 wherein said first color interlock means and said second color interlock means are arranged in a series circuit with said signal means such that when said signal means is in a display position of said first color and not in a display position of said second color then said first current path is in series with said signal means and said fourth current path, and when said signal means is in a display position of said second color and not in a display position of said first color then said second current path is in series with said signal means and said third current path.

3. The searchlight signal arrangement of claim 2 wherein said first color interlock means and said second color interlock means are arranged in a series circuit with said signal means such that when said signal means is not in a display position of said first color and not in a display of said second color then said signal means is in series with said third current path and said fourth current path.

4. The searchlight circuit arrangement of claim 2 wherein said first and second color interlock means each comprises a lens switch mechanically interlocked to at least one moveable color lens and each of said lens switches have a moveable contact connected in series with said signal means and each of said lens switches has a fixed display contact that is connected to respective of said moveable contact when a lens of the corresponding color is displayed and a fixed not displayed contact that is electrically connected to respective of said moveable contact when a lens of said color is not displayed.

5. The searchlight signal circuit arrangement of claim 1 wherein said bipolar means is selectively electrically connected to at least one of said first color interlocking means and said second color interlocking means.

6. The searchlight signal circuit arrangement of claim 5 wherein said bipolar means is selectively electrically connected to at least one of said first current path, second current path, third current path, and fourth current path.

7. The searchlight signal circuit arrangement of claim 5 wherein said bipolar means is connected with a polarity corresponding to position said second color to the selectively established fourth current path corresponding to the not displayed second color position.

8. The searchlight signal circuit arrangement of claim 7 wherein said second color is green.

9. The searchlight signal circuit arrangement of claim 2 wherein said first color is yellow and said second color is green, and wherein said signal is in a display red position when it is in a not display yellow and a not display green position.

10. The searchlight signal circuit arrangement of claim 1 further comprising wayside control means electrically connected to but remote from said signal means and said interlock means by a multiconductor cable means; and said wayside control means having logic means for selectively applying electrical signals of varying polarity to said conductors.

11. The searchlight signal circuit arrangement of claim 10 having a multiconductor cable means having five or less electrical conductors.

12. The searchlight signal circuit arrangement of claim 10 wherein said logic means selectively applies a positive voltage signal to a first conductor in said cable, and said first conductor is connected to remotely located input of said first color interlock means and said second color interlock means at said first current path and said second current path respectively.

13. The searchlight signal circuit arrangement of claim 12 wherein the logic means supplies control signals to said bipolar means to selectively establish a first color position and a second color position.

14. The searchlight signal circuit arrangement of claim 2 further comprising wayside control means electrically connected to but remote from said signal means and said interlock means by a multiconductor cable means;

said wayside control means having logic means for selectively applying electrical signals of varying polarity to said conductors; and wherein said logic means selectively applies a positive voltage signal to a first conductor in said cable, and said first conductor is connected to remotely located input of said first color interlock means and said second color interlock means at said first current path and said second current path respectively.

15. The searchlight signal circuit arrangement of claim 14 wherein the logic means supplies control signals to said bipolar means to selectively establish a first color position and a second color position.

16. The searchlight signal circuit arrangement of claim 4 further comprising wayside control means electrically connected to but remote from said signal means and said interlock means by a multiconductor cable means;

said wayside control means having logic means for selectively applying electrical signals of varying polarity to said conductors; and wherein said logic means selectively applies a positive voltage signal to a first conductor in said cable, and said first conductor is connected to remotely located input of said first color interlock means and said second color interlock means at said first current path and said second current path respectively.

17. The searchlight signal circuit arrangement of claim 7 further comprising wayside control means electrically connected to but remote from said signal means and said interlock means by a multiconductor cable means;

said wayside control means having logic means for selectively applying electrical signals of varying polarity to said conductors; and wherein said logic means selectively applies a positive voltage signal to a first conductor in said cable, and said first conductor is connected to remotely located input of said first color interlock means and said second color interlock means at said first current path and said second current path respectively.

18. The searchlight signal circuit arrangement of claim 7 further comprising wayside control means electrically connected to but remote from said signal means and said interlock means by a multiconductor cable means;

said wayside control means having logic means for selectively applying electrical signals of varying polarity to said conductors;

said logic means selectively applies a positive voltage signal to a first conductor in said cable, and said first conductor is connected to remotely located input of said first color interlock means and said second color interlock means at said first current path and said second current path respectively; and wherein the logic means supplies control signals to said bipolar means to selectively establish a first color position and a second color position.

19. The searchlight signal circuit arrangement of claim 9 further comprising wayside control means electrically connected to but remote from said signal means and said interlock means by a multiconductor cable means;

said wayside control means having logic means for selectively applying electrical signals of varying polarity to said conductors; and wherein said logic means selectively applies a positive voltage signal to a first conductor in said cable, and said first conductor is connected to remotely located input of said first color interlock means and said second color interlock means at said first current path and said second current path respectively.

20. The searchlight signal circuit arrangement of claim 9 further comprising wayside control means electrically connected to but remote from said signal means and said interlock means by a multiconductor cable means;

said wayside control means having logic means for selectively applying electrical signals of varying polarity to said conductors;

wherein said logic means selectively applies a positive voltage signal to a first conductor in said cable, and said first conductor is connected to remotely located input of said first color interlock means and said second color interlock means at said first current path and said second current path respectively; and wherein the logic means supplies control signals to said bipolar means to selectively establish a first color position and a second color position.

21. The searchlight signal circuit arrangement of claim 10 wherein said logic means supplies an electrical signal of a first polarity to said cable means to energize said signal means through said first color interlock switch and second color interlock switch; and said logic means having fail-over relay means for providing said first polarity voltage when a display of either said first or second color is desired, and for providing an electrical voltage signal having a polarity opposite from said first polarity when said fail-over relay drops out indicating a desire to not display a visible signal.

22. The searchlight signal circuit arrangement of claim 21 wherein said logic means selectively applies a positive voltage signal to a first conductor in said cable, and said first conductor is connected to remotely located input of said first color interlock means and said second color interlock means at said first current path and said second current path respectively.

* * * * *